US010415221B2

(12) United States Patent
Mallela et al.

(10) Patent No.: US 10,415,221 B2
(45) Date of Patent: Sep. 17, 2019

(54) ADJUSTABLE TOILET FLUSH LEVER ARM ASSEMBLY

(71) Applicant: FLUIDMASTER, INC., San Juan Capistrano, CA (US)

(72) Inventors: Venkat Mallela, San Marcos, CA (US); Shijin Komath, Mambaram (IN); Jithin Karukasseril Vijayan, Kalpetta North (IN); Manivannan Venkatachalam, Rasipuram (IN)

(73) Assignee: FLUIDMASTER, INC., San Juan Capistrano, CA (US)

( * ) Notice: Subject to any disclaimer, the term of this patent is extended or adjusted under 35 U.S.C. 154(b) by 0 days.

(21) Appl. No.: 15/742,834

(22) PCT Filed: May 27, 2016

(86) PCT No.: PCT/US2016/034571

§ 371 (c)(1),
(2) Date: Jan. 8, 2018

(87) PCT Pub. No.: WO2017/007540

PCT Pub. Date: Jan. 12, 2017

(65) Prior Publication Data

US 2018/0202137 A1 Jul. 19, 2018

Related U.S. Application Data

(60) Provisional application No. 62/189,762, filed on Jul. 8, 2015.

(51) Int. Cl.
*E03D 5/092* (2006.01)
*E03D 1/34* (2006.01)

(52) U.S. Cl.
CPC ..... *E03D 5/092* (2013.01); *E03D 1/34* (2013.01)

(58) Field of Classification Search
CPC ..... E03D 5/092; E03D 1/34
USPC ..... 4/405, 413, 414
See application file for complete search history.

(56) References Cited

U.S. PATENT DOCUMENTS

| | | | | |
|---|---|---|---|---|
| 3,046,565 | A * | 7/1962 | Taylor | E03D 5/092 4/414 |
| 5,491,848 | A | 2/1996 | Wang | |
| 5,878,775 | A | 3/1999 | Tamburro, Jr. | |
| 6,643,855 | B1 | 11/2003 | Huang | |
| 8,800,070 | B2 | 8/2014 | Hornberger | |
| 2006/0225196 | A1 | 10/2006 | Yang | |
| 2007/0240256 | A1 | 10/2007 | Tau | |

(Continued)

FOREIGN PATENT DOCUMENTS

| | | |
|---|---|---|
| WO | 2014/186417 | 11/2014 |

OTHER PUBLICATIONS

International Search Report issued in connection to International Patent Application No. PCT/US2016/034571; dated Aug. 31, 2016; 2 pages; United States.

(Continued)

*Primary Examiner* — Tuan N Nguyen
(74) *Attorney, Agent, or Firm* — Greenberg Traurig, LLP

(57) ABSTRACT

A toilet flush lever assembly having an adjustable length internal lever arm with a variable angle of connection to a short arm that passes through the wall of the toilet tank such that the angle of mounting of the adjustable length internal lever arm to an external flush lever arm is adjustable.

15 Claims, 18 Drawing Sheets

(56) References Cited

U.S. PATENT DOCUMENTS

| | | | |
|---|---|---|---|
| 2008/0072371 | A1 | 3/2008 | Rogers |
| 2014/0259342 | A1 | 9/2014 | Le |

OTHER PUBLICATIONS

PCT Written Opinion of the International Searching Authority issued in connection to International Patent Application No. PCT/US2016/034571; dated Aug. 31, 2016; 6 pages; United States.

* cited by examiner

ADJUSTABLE TOILET FLUSH LEVER ARM ASSEMBLY

RELATED APPLICATION

The present application is the 35 U.S.C. § 371 national application of International Patent Application No. PCT/US2016/034571, filed May 27, 2016, which designated the United States and claims priority to U.S. Provisional patent application 61/189,762, entitled "ADJUSTABLE TOILET FLUSH LEVER ARM ASSEMBLY", filed on Jul. 8, 2015, the disclosure and contents of which are incorporated herein by reference in its entirety for all purposes.

TECHNICAL FIELD

The present invention relates to toilet flush levers.

BACKGROUND OF THE INVENTION

Toilet flush lever assemblies typically include an external flush lever mounted on the outside of the toilet bowl which is acted upon by a user. The external flush lever is mechanically connected to an internal lever which moves within the toilet tank upon movement of the external flush lever. The internal lever arm is mechanically connected to a toilet flapper, typically by a chain. A toilet flapper acts as a valve to the fluid outlet of a toilet tank, and seals the outlet when the flapper is not engaged by the flush lever arm.

When a user pushes the external lever down (usually causing rotational movement about the axis through which it is mounted on the toilet tank) it causes the internal lever to also move, which engages the chain and lifts the flapper, opening the fluid outlet and permitting for the evacuation of water from the toilet tank into the toilet bowl.

Because the relative location between the toilet flush lever assembly and toilet flapper are not standard throughout the industry and among brands, replacement lever arms must either be purpose-manufactured for particular toilet models, or else, they must be adjustable to work with multiple toilets having various differences in relative locations between the flush lever mount and the flapper. Also, because toilet flush levers are used frequently and in moist environments, the assemblies can degrade over time, needing replacement.

What is instead desired is a simple, easy to install toilet flush lever assembly that can be used with a wide variety of toilet models having toilet tanks of different shapes and sizes. Ideally, such an assembly would be easily retro-fit onto these different toilet models such that it would hold the end of the flapper chain directly over the flapper valve itself, such that the chain would be pulled straight up to unseat the flapper valve.

SUMMARY OF THE INVENTION

The present invention provides a toilet flush lever arm assembly, comprising: (a) an external flush lever arm; (b) a short arm passing through the wall of the toilet tank and connected to the external flush lever arm; and (c) an adjustable length internal lever arm also connected to the short arm. Preferably, the short arm holds the adjustable length internal lever arm at an angle that is adjustable.

In one embodiment, the adjustable length internal lever arm comprises: (i) an inner shaft, (ii) a hollow outer slider received onto the inner shaft, and (iii) a locking mechanism to fix the inner shaft at a desired position along the length of the hollow outer slider. In one embodiment, the locking mechanism may comprise a projection on the inner shaft that protrudes through one of several apertures on the hollow outer slider.

In some embodiments, the hollow outer slider remains in a fixed position with the inner shaft being moveable in a distal or proximal direction within the hollow outer slider. In these embodiments, the chain of a flush valve is connected to the inner shaft. In other embodiments, the inner shaft remains in a fixed position with the hollow outer slider being moveable in the distal or proximal direction. In these embodiments, the chain of a flush valve is connected to the hollow outer slider.

In one embodiment, the locking mechanism in the adjustable length internal lever arm may comprise deflectable snaps on the hollow outer slider that rotate to lock into apertures in the inner shaft. Alternatively, the locking mechanism a protrusion on the interior of the hollow outer slider.

Various embodiments of different interlocking teeth are presented for connecting the short arm to the adjustable length internal lever arm such that the angle of connection can be varied by an operator as desired.

Advantages of the present system include both the adjustability both of the length of the internal lever arm (which lifts the chain to unseat the flapper valve), and of the angle at which the internal lever arm is itself mounted within the tank. This makes the internal lever arm easily positionable within a wide variety of sizes and shapes of toilet tanks (including front-mount, side-mount, angle-mount and even right-hand-flush toilet lever configurations). Specifically, because the axially adjustable internal lever arm also includes a radially adjustable interlock with the short arm, it provides the advantage of positioning the distal end of the internal lever arm directly (or near directly) over the flapper, thus creating a better connection and superior flush lever mechanism. Moreover, because the axially adjustable internal lever arm may comprise as few as two pieces, it provides the advantage of lower production costs, easier assembly, and increased reliability.

DETAILED DESCRIPTION OF THE DRAWINGS

FIGS. 1A to 1D illustrate a toilet flush lever arm assembly 10, comprising: an external flush lever arm 20; a short arm 30 connected to external flush lever arm 20; and an adjustable length internal lever arm 40 connected to short arm 30.

Figure 1A:
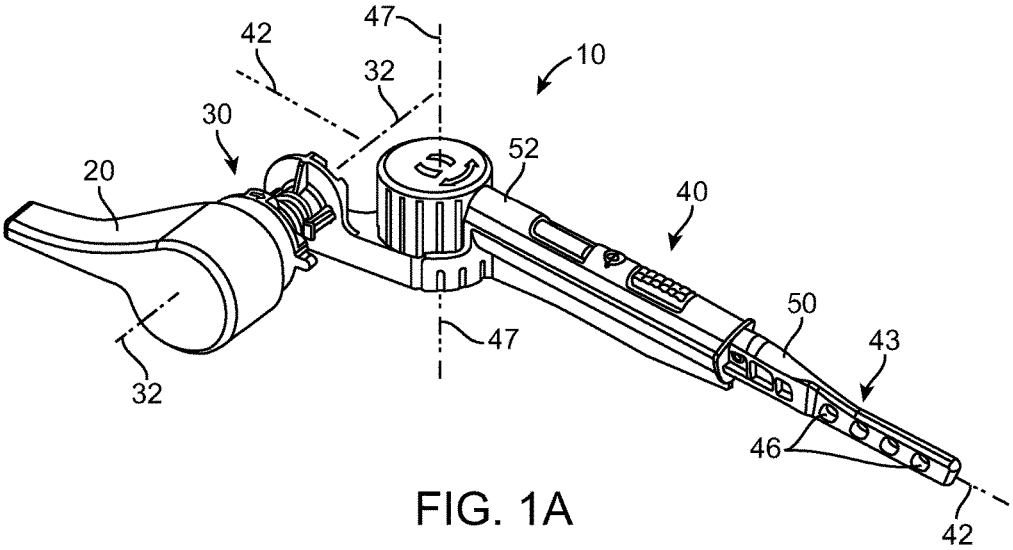
FIG. 1A is a perspective view of a first embodiment of the present lever arm assembly.
Figure 1B:
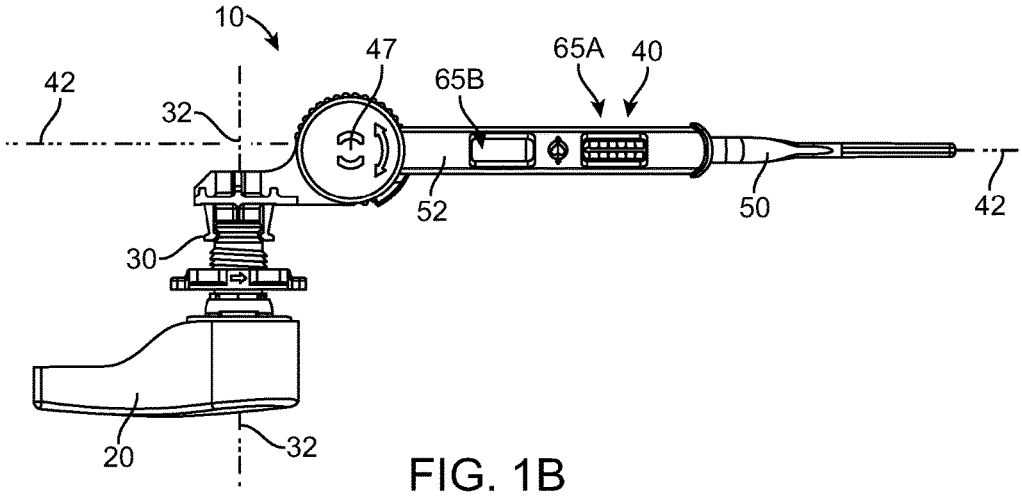
FIG. 1B is a top plan view corresponding to FIG. 1A.
Figure 1C:
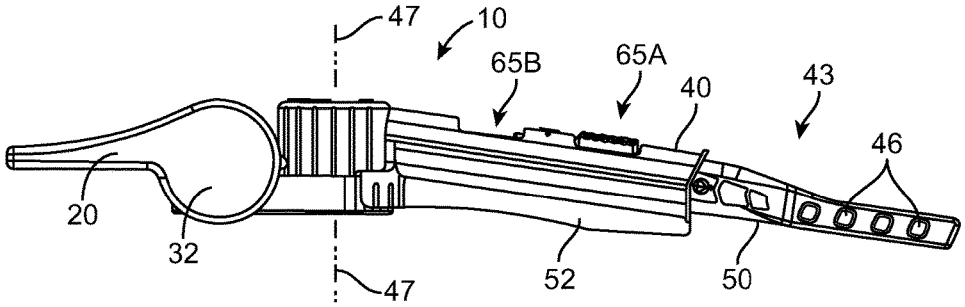
FIG. 1C is a side elevation view corresponding to FIG. 1A.

Short arm 30 passes through a wall of a toilet tank (not shown) and external flush lever arm 20 rotates around a longitudinal axis 32 passing centrally through short arm 30. As will be explained herein, short arm 30 holds adjustable length internal lever arm 40 at an adjustable angle. As seen in FIG. 1B, this adjustable angle may be 90 degrees (i.e.: the angle between axes 32 and 42). As will be explained, arm 40 is rotatable about axis 47.

As can also be seen, the distal end 43 of the adjustable length internal lever arm 40 preferably comprises a plurality of apertures 46 for connecting to the chain (not shown) of a toilet flapper assembly.

Figure 1D:
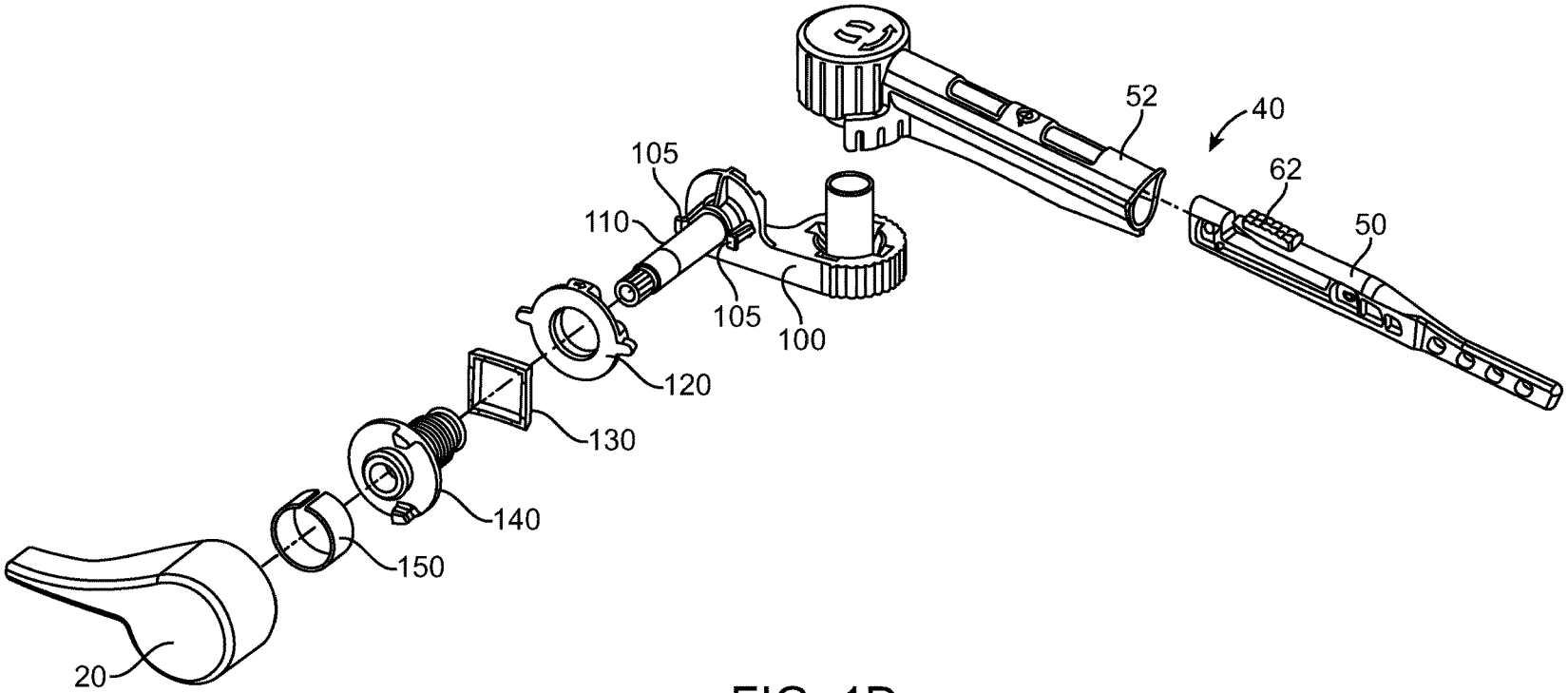
FIG. 1D is an exploded perspective view corresponding to FIG. 1A.
Figure 2A:
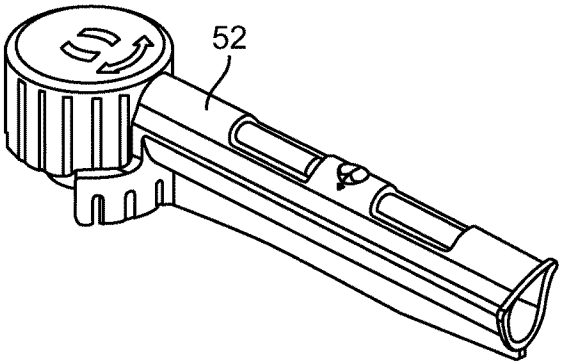
FIG. 2A is perspective view of the hollow outer slider of the adjustable length arm seen in FIG. 1A.
Figure 2B:
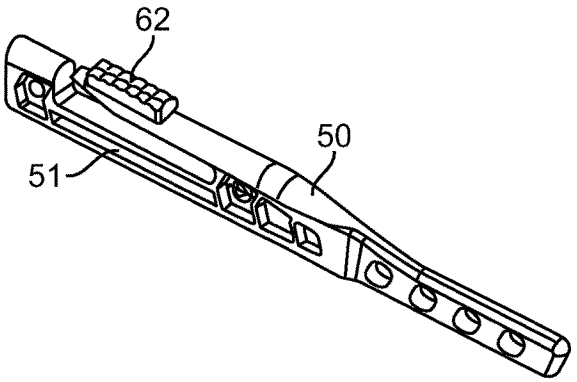
FIG. 2B is a perspective view of the inner shaft of the adjustable length arm seen in FIG. 1A.

As seen in FIGS. 1D, 2A and 2B, the adjustable length internal lever arm 40 may comprise: an inner shaft 50, and a hollow outer slider 52 received onto inner shaft 50. The length of arm 40 is adjusted by moving inner shaft 50 back and forth within outer slider 52.

Figure 1E:
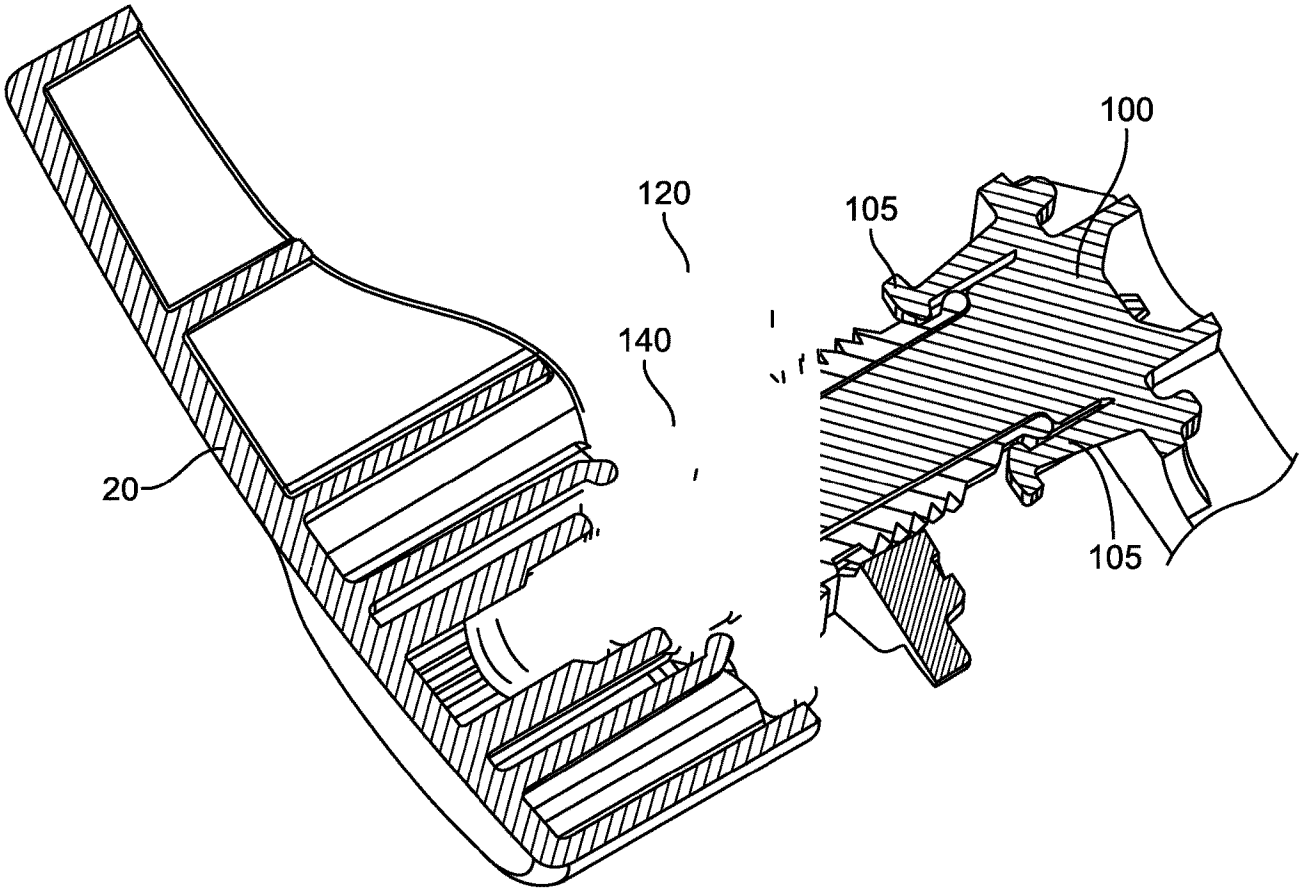
FIG. 1E is a sectional view of the interlocking of the handle, short arm and long arm seen in FIG. 1A.

As also seen in FIG. 1D, short arm 30 may optionally include one or more of a distal mount 100 having locking arms 105, and a tubular projection 110. Also included are an optional nut 120, washer 130, chassis 140 and clip 150. As seen in FIG. 1E, the components of short arm 30 can be snap-fit together with the distal end of chassis 140 held by locking arms 105, and the proximal end of tubular projection 110 being received within handle 20.

In preferred embodiments, seen in FIGS. 1A through 3B, the adjustable length internal lever arm 40 comprises: an inner shaft 50, a hollow outer slider 52 received onto inner shaft 50, and a locking mechanism to fix the inner shaft 50 at a desired position along within the length of outer slider 52. Specifically, inner shaft 50 preferably has a projection 62 thereon. Preferably, the inner shaft 50 has a hollow mid-section 51 (FIG. 2B) adjacent to the projection thereon to permit projection 62 to flex inwardly when depressed.

Figure 3A:
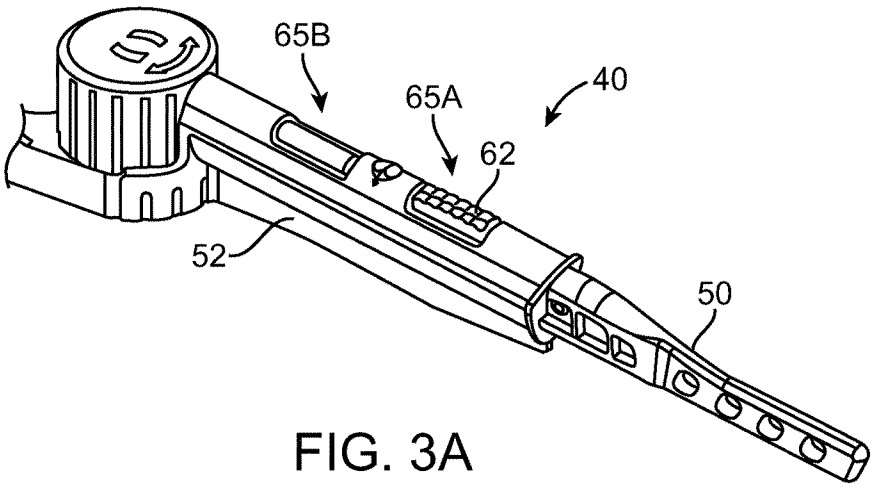
FIG. 3A is a perspective view of the adjustable length internal lever arm of FIG. 1A with the internal lever arm at maximum length.
Figure 3B:
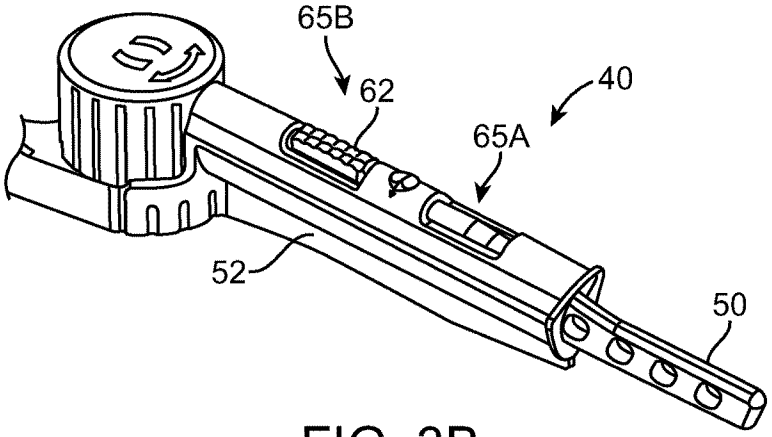
FIG. 3B is a perspective view of the adjustable length internal lever arm of FIG. 1A with the internal lever arm at minimum length.

As seen in FIGS. 3A and 3B, projection 62 on inner shaft 50 protrudes through one of apertures 65 to fix the hollow outer slider at a desired position along the length of inner shaft 50. Specifically, when projection 62 is positioned to project out of aperture 65A (FIG. 3A), then internal lever arm 40 is extended to its maximum length. Conversely, when projection 62 is positioned to project out of aperture 65B (FIG. 3B), then internal lever arm 40 is reduced to its minimum length. In optional embodiments having more than two apertures 65, intermediate length settings will be provided.

Figure 4A:
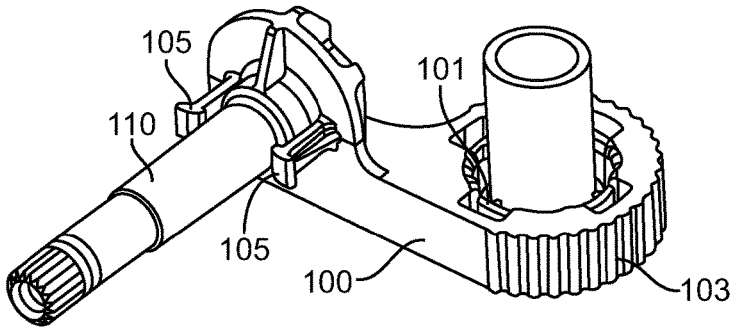
FIG. 4A is a perspective view of the locking mechanism at the distal end of the short arm seen in FIG. 1A.
Figure 4B:
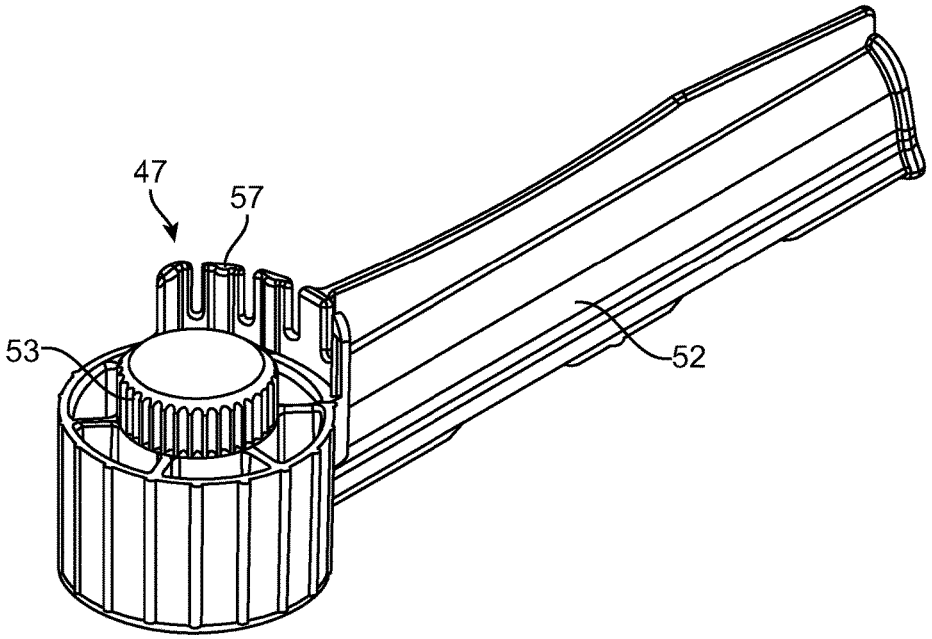
FIG. 4B is a perspective view of the locking mechanism at the proximal end of the internal lever arm seen in FIG. 1A.

FIGS. 4A and 4B illustrate an interlocking mechanism between distal mount 100 of short arm 30 (FIG. 4A) and proximal end 41 of outer slider 52. Specifically, distal mount 100 has an internal ratchet 101 and an external ratchet surface 103 Outer slider 52 has an internal ratchet surface 53 and external ratchet arms 57. In operation, elements 103 and 57 mate together and elements 101 and 53 mate together (when surface 103 is received within arms 57 and surface 53 is received within ratchet elements 101.

Figure 5A:
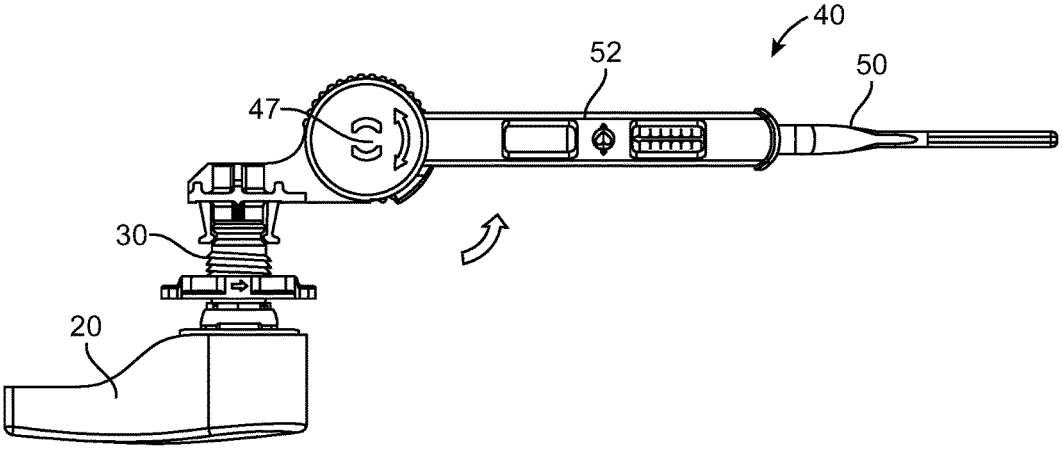
FIG. 5A is a top plan view of the present assembly used with a left-handed toilet handle.
Figure 5B:
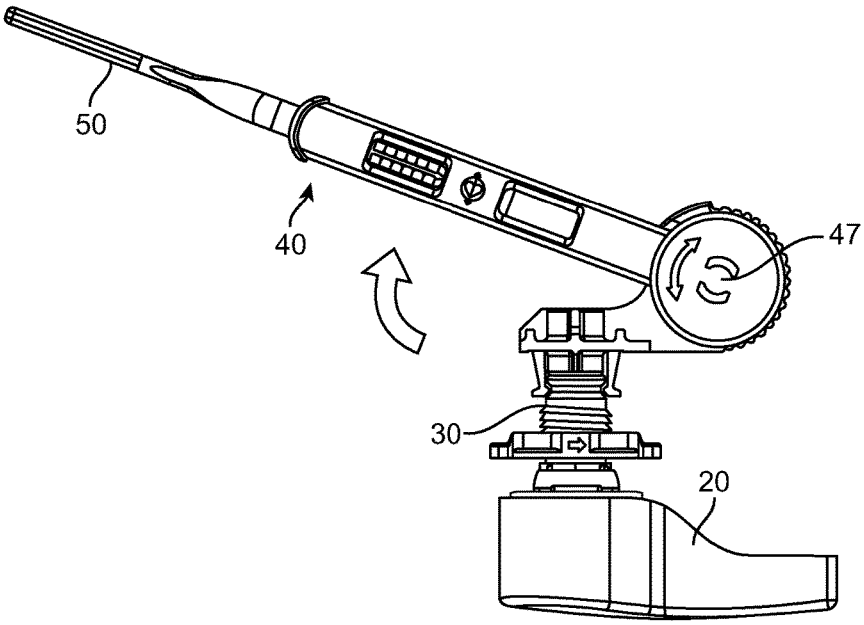
FIG. 5B is a top plan view of the present assembly used with a right-handed toilet handle.

FIG. 5A illustrates an installation on a left-handed toilet. Typically, the installer rotates variable length long arm 40 in a counterclockwise direction about axis 47 to reach a desired position with inner shaft 50 over the flapper valve (not illustrated) below. FIG. 5B illustrates a right-handed toilet. Typically, the installer rotates variable length long arm 40 in a clockwise direction about axis 47 to reach a desired position with inner shaft 50 over the flapper valve (not illustrated) below.

Figure 6A:
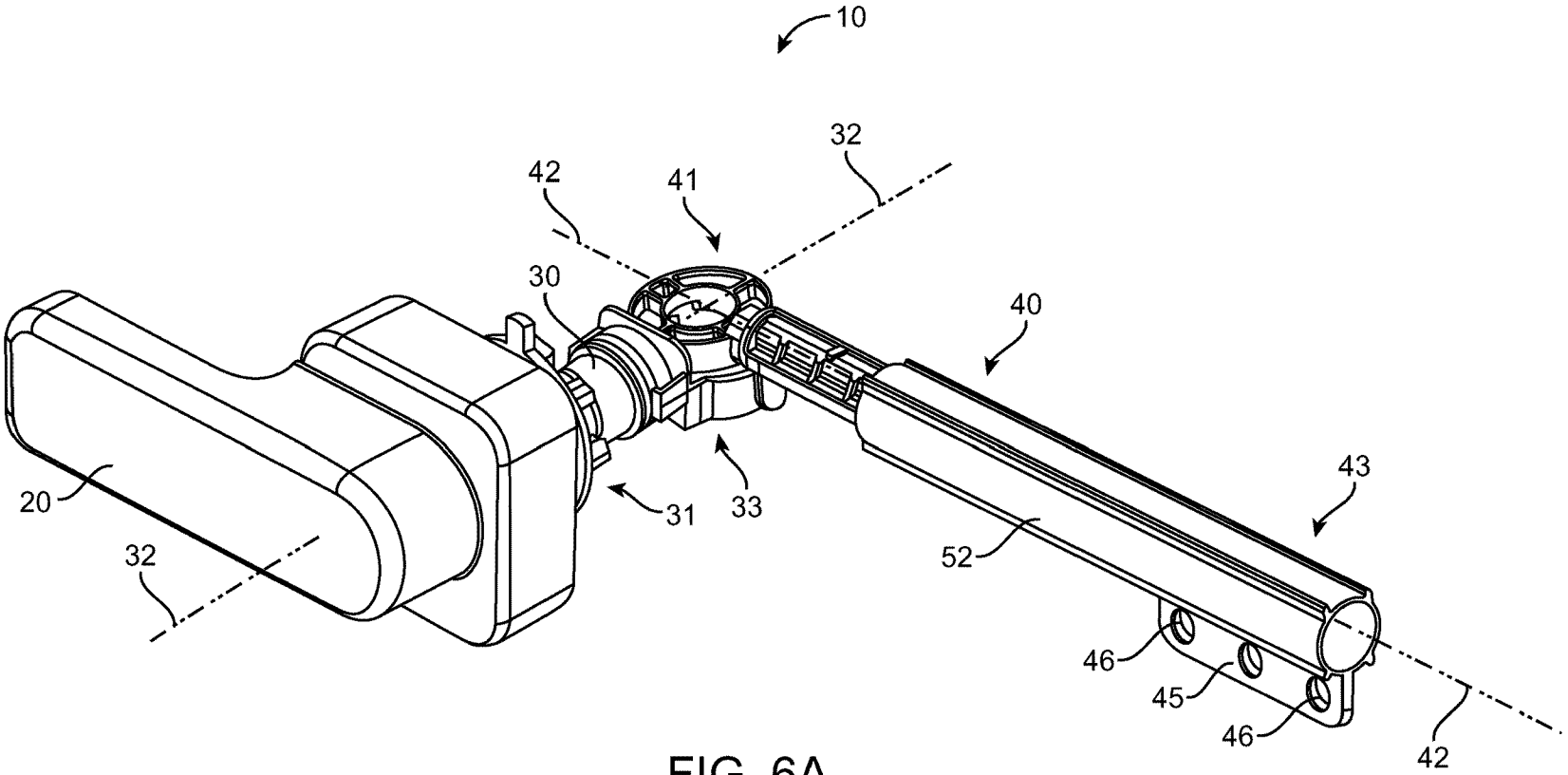
FIG. 6A is a perspective view of a second embodiment of the present lever arm assembly.
Figure 6B:
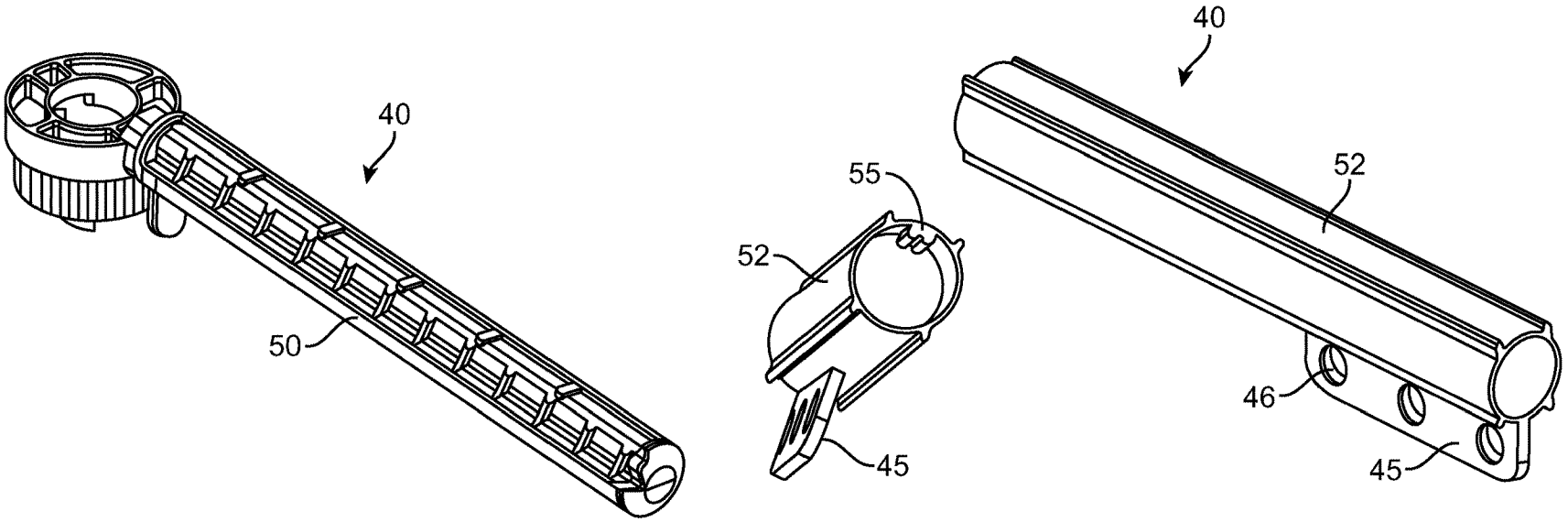
FIG. 6B is an exploded perspective view of the internal lever arm seen in FIG. 6A.
Figure 6C:
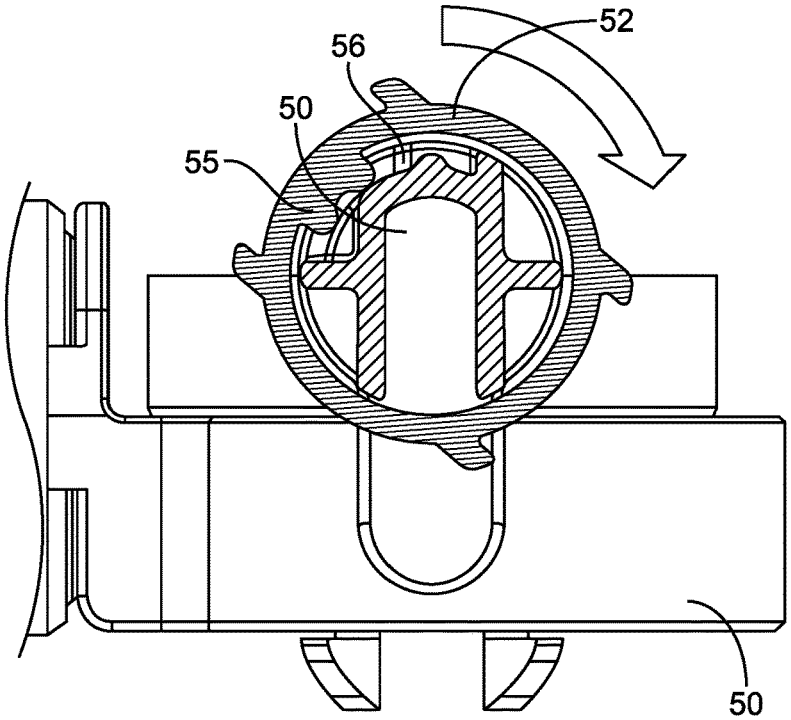
FIG. 6C is a sectional elevation view of the locking mechanism of FIGS. 6A and 6B in an unlocked position.
Figure 6D:
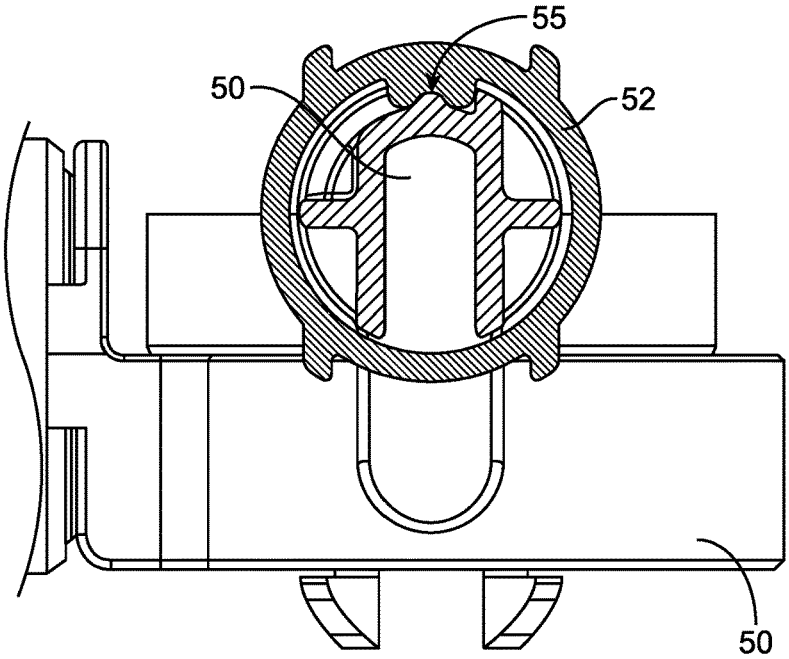
FIG. 6D is a sectional elevation view of the locking mechanism of FIGS. 6A and 6B in a locked position.

FIGS. 6A to 6D illustrate an alternative embodiment of the adjustable length internal lever arm 40, comprising a moveable hollow slider 52 with a projection 54 thereon. (Note: FIG. 6B shows two outer sliders 52 rotated such that both ends of the slider 52 can be seen). Slider 52 also has a flange 45 extending therefrom with apertures 46 therein. As seen in FIGS. 6C and 6D, the locking mechanism may optionally comprises deflectable snaps 55 on the hollow outer slider 52 that rotate to lock into apertures 56 in inner shaft 50.

Figure 7A:
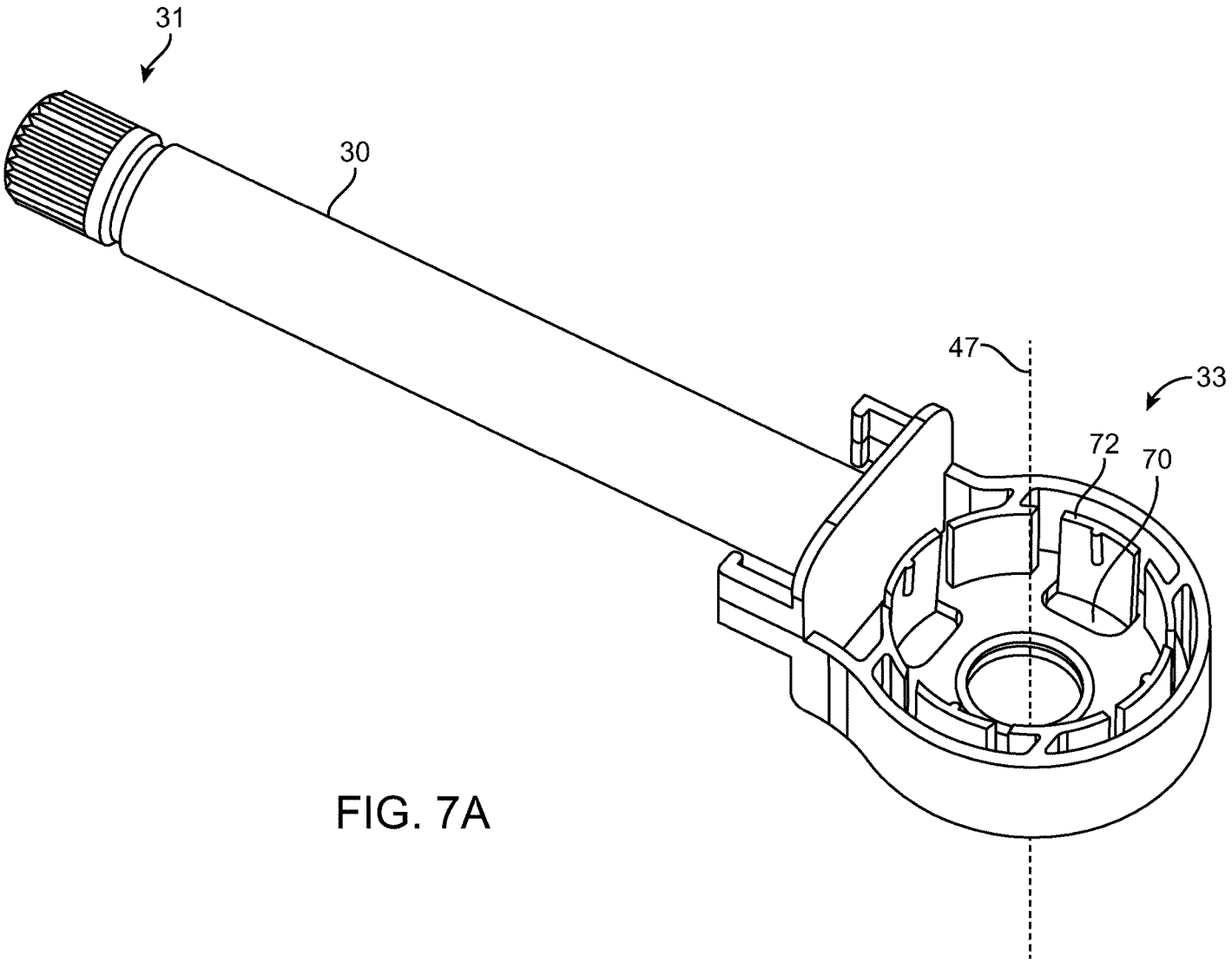
FIG. 7A is a perspective view of another embodiment of the locking mechanism of the short arm.
Figure 7B:
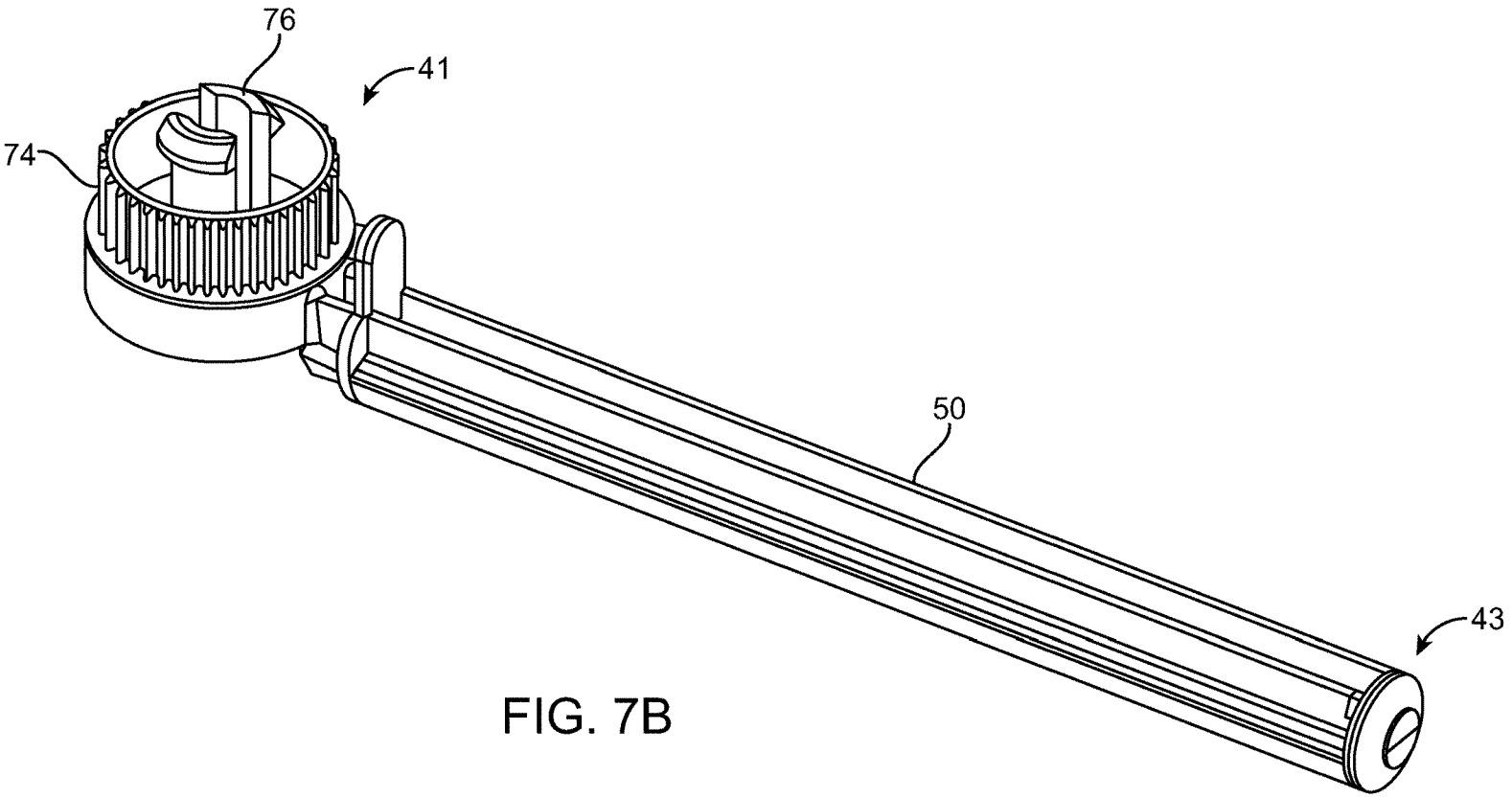
FIG. 7B is a perspective view of an embodiment of the internal arm for use with the locking mechanism of the short arm of FIG. 7A.

FIGS. 7A and 7B illustrate an alternative embodiment of the locking mechanism for securing the position of internal lever arm 40 about axis 47. Specifically, adjustable length internal lever arm 40 and short arm 30 each comprise interlocking connection mechanisms that allow for locking and unlocking of adjustable length internal lever 40 arm at different angles about axis 47 with respect to short arm 30, as follows. As seen in FIG. 7A, distal end 33 of short arm 30 may optionally comprise outwardly deflectable teeth 70, and holes 72. As seen in FIG. 7B, the proximal end 41 of inner shaft 50 may comprise outwardly facing teeth 74 and deflectable snaps 76.

Once the preferred angle between short arm 30 and internal lever arm 40 has been set, (i.e.: once the preferred angle about axis 47 and between axes 32 and 43 has been set), teeth 74 of arm 40 are inserted within outwardly deflectable teeth 70 of short arm 30. In addition, the ends of deflectable snaps 76 are positioned within holes 72, thus snapping arms 30 and 40 together (thereby holding arms 30 and 40 together at a preferred angle to one another).

Figure 8A:
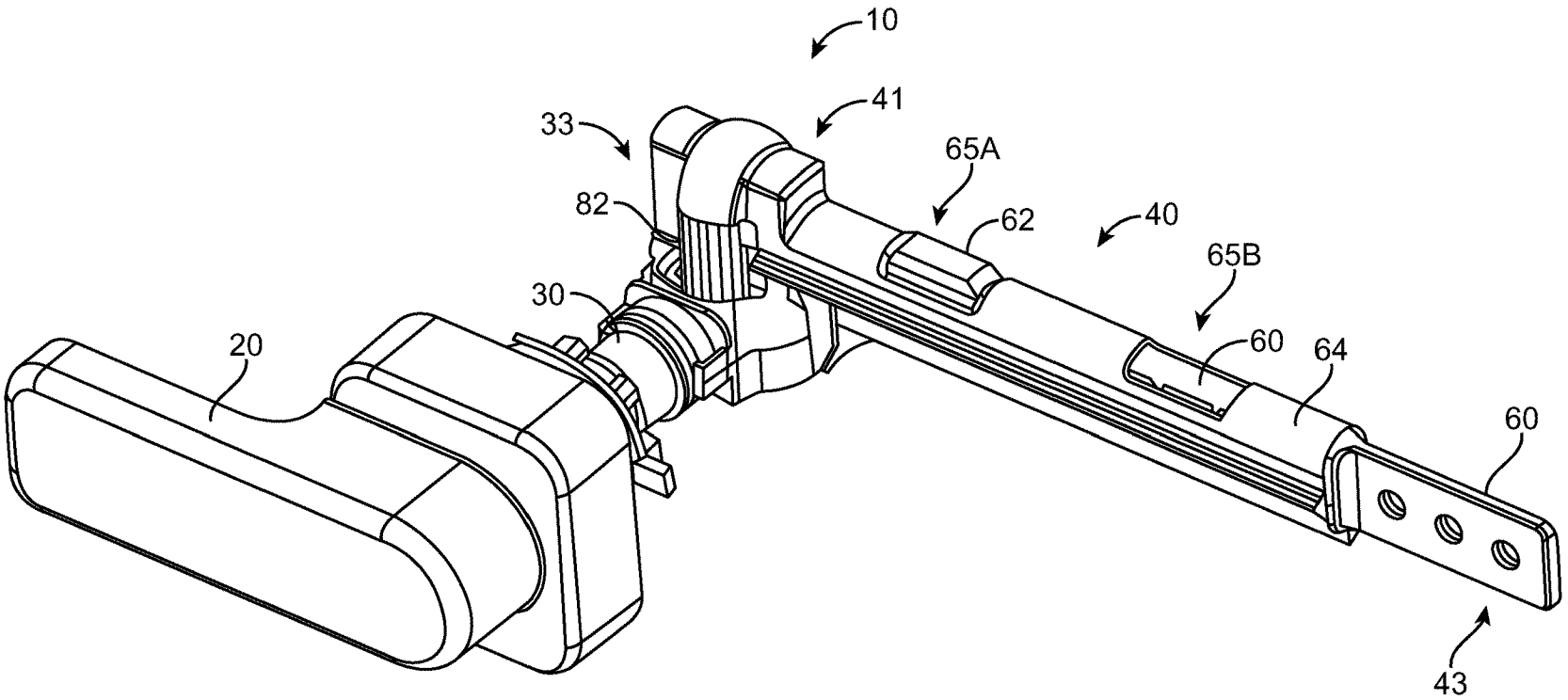
FIG. 8A is a perspective view of a third embodiment of the present lever arm assembly.
Figure 8B:
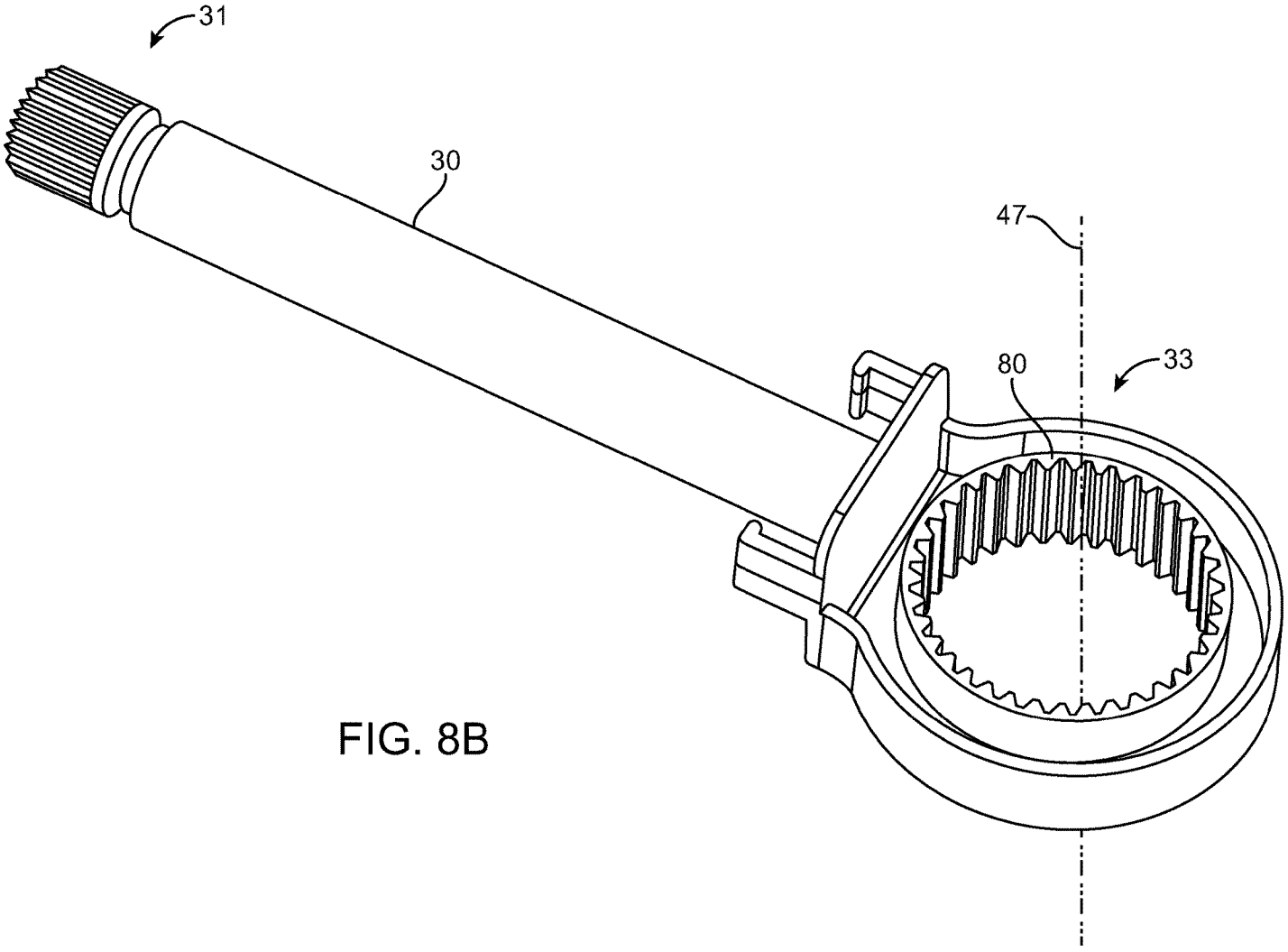
FIG. 8B is a perspective view of the short arm seen in FIG. 8A.
Figure 8C:
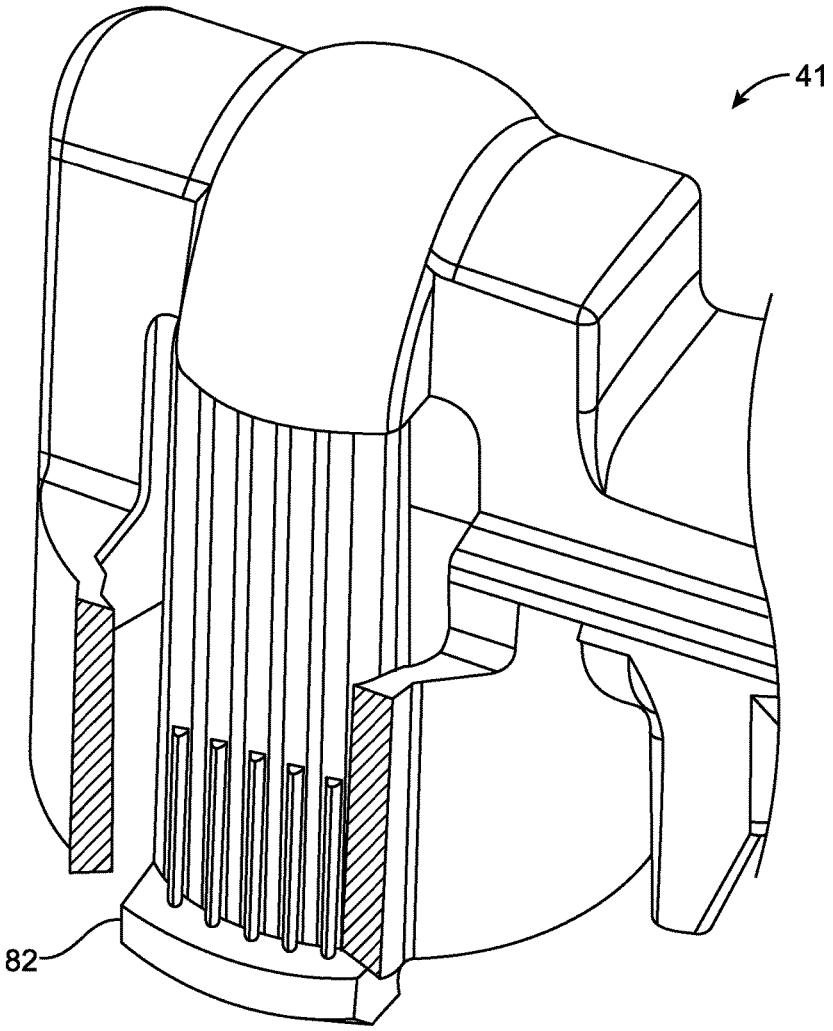
FIG. 8C is a perspective view of the proximal end of the internal lever arm seen in FIG. 8A.
Figure 8D:
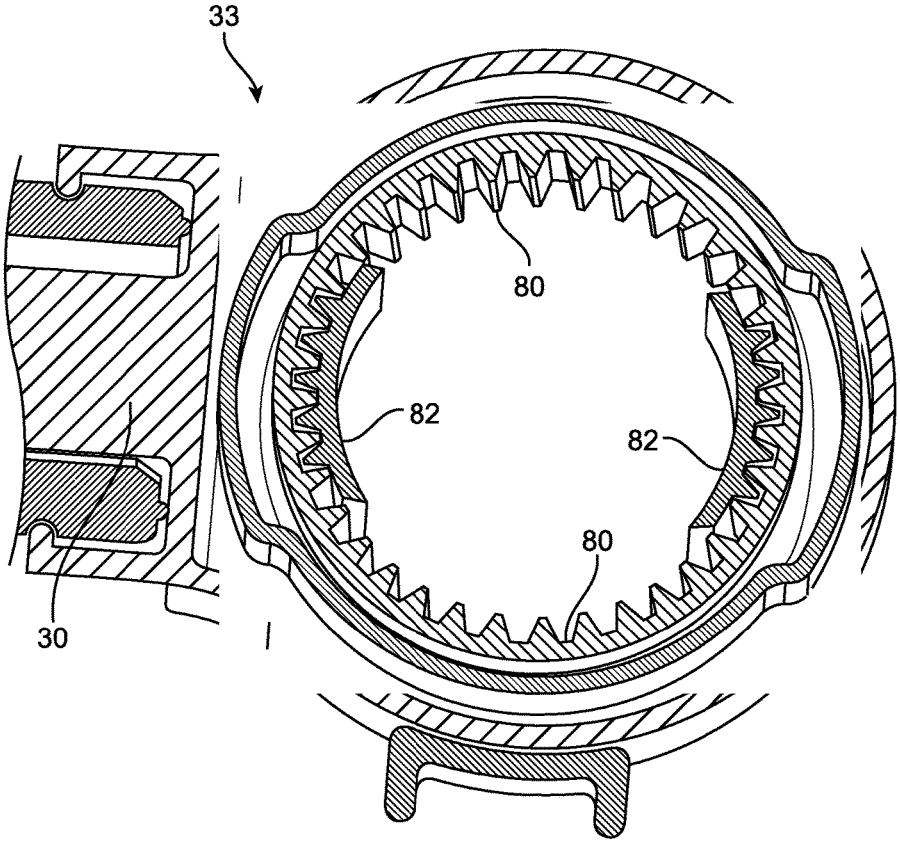
FIG. 8D is a sectional view showing the teeth of the internal lever arm of FIG. 8B interconnecting to the teeth of the short arm of FIG. 8C.

FIGS. 8A to 8D illustrate another alternative embodiment of the connection mechanisms in which distal end 33 of short arm 30 comprises inwardly facing teeth 80, and the proximal end 41 of internal lever arm 40 comprises inwardly deflectable teeth 82. When snapped together, inwardly deflectable teeth 82 are received within inwardly facing teeth 80 (as best seen in FIG. 8D). As seen in FIG. 8C, an operator pushes inwardly deflectable teeth 82 inwardly such that they move away from inwardly facing teeth 80. The operator simply holds inwardly deflectable teeth 82 inwardly and then rotates adjustable length lever arm 40 to its desired position about axis 47. Then, when inwardly deflectable teeth 82 are released, they will spring outwardly against inwardly facing teeth 80, locking the position of arm 30 and 40 together.

Figure 9A:
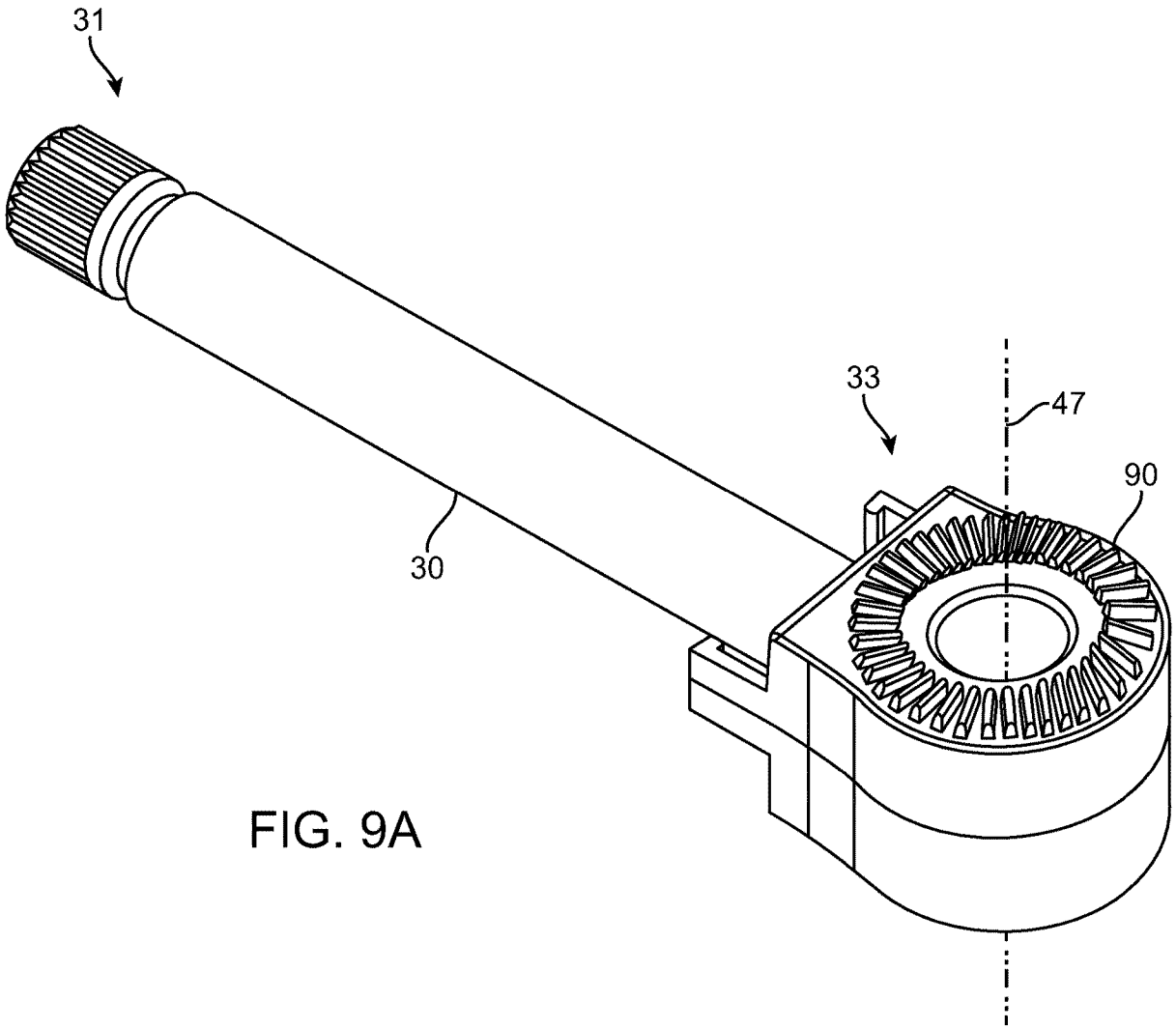
FIG. 9A is a perspective view of another embodiment of the short arm.
Figure 9B:
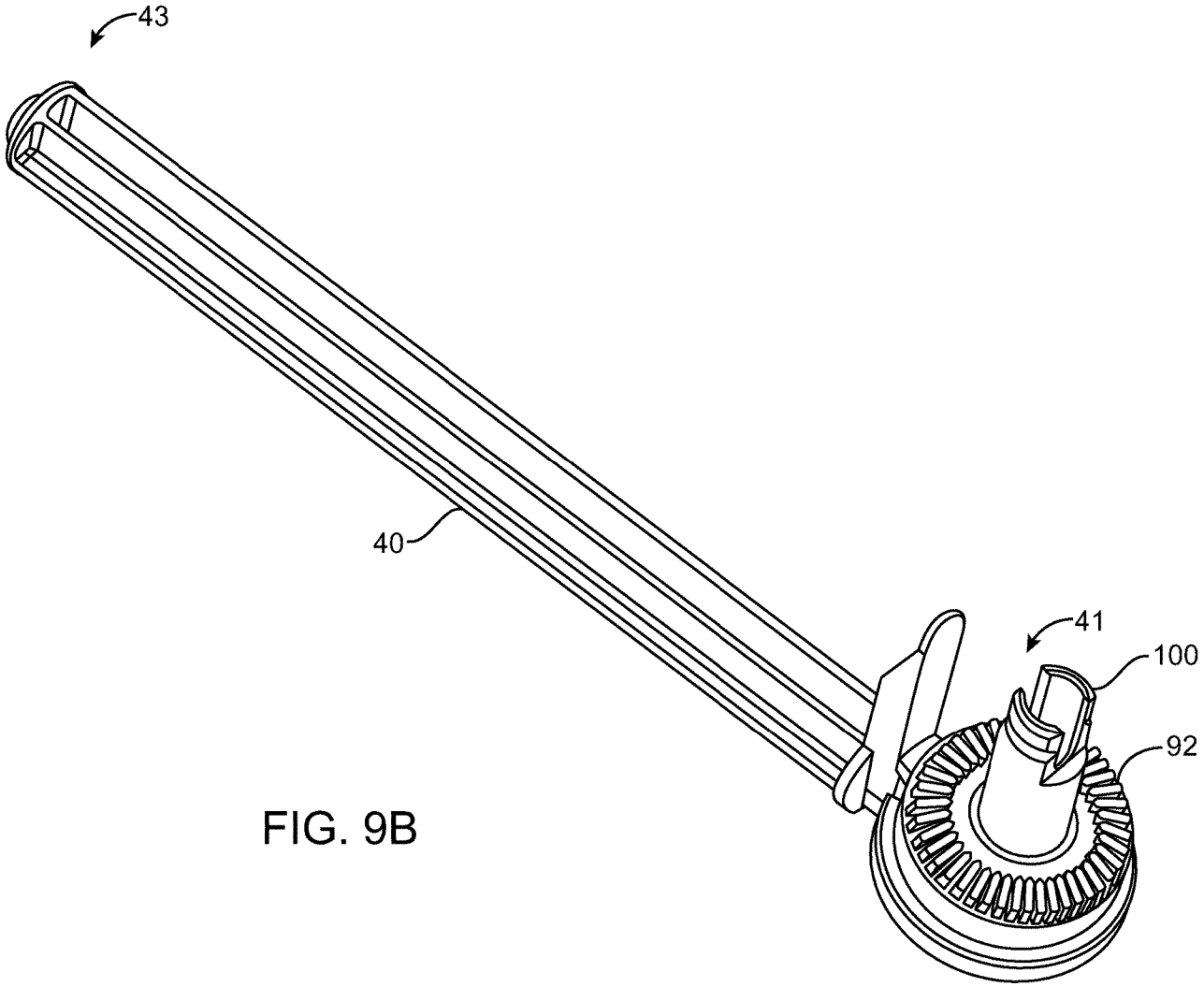
FIG. 9B is a perspective view another embodiment of the internal lever arm for use with the short arm of FIG. 9A.
Figure 9C:
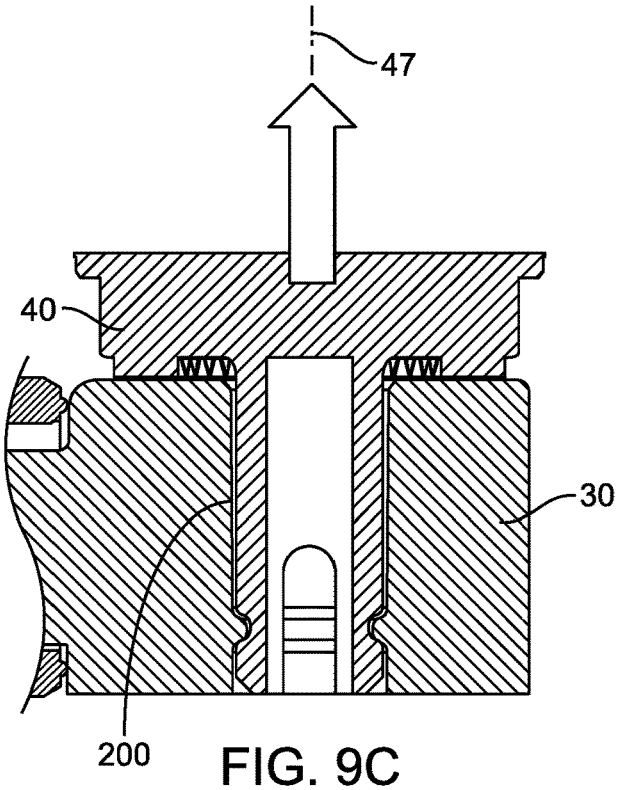
FIG. 9C a sectional elevation view of the lever assembly seen in FIGS. 9A and 9B, showing a connector pin in a lowered, locked position.
Figure 9D:
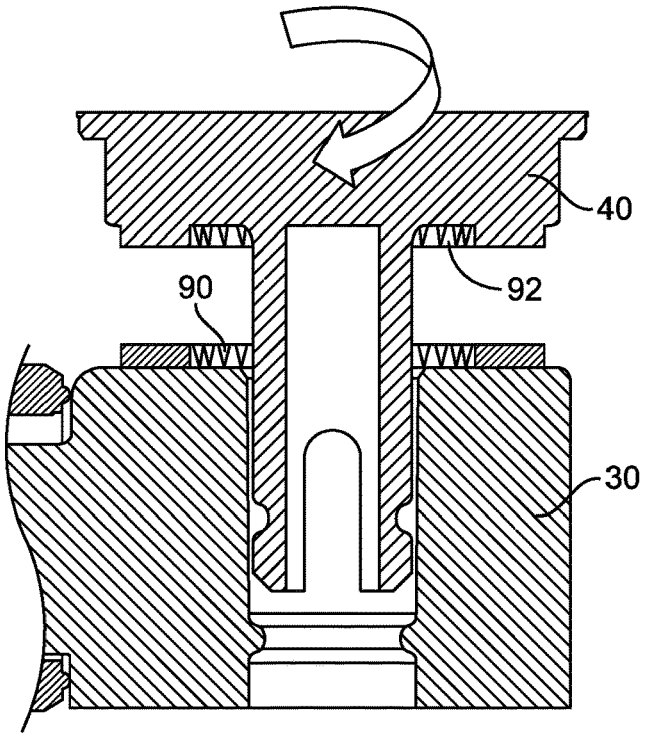
FIG. 9D shows the connector pin of FIG. 9C in a raised unlocked position.

FIGS. 9A to 9D illustrate another alternative embodiment of the connection mechanisms in which distal end 33 of short arm 30 comprises vertically projecting gear teeth 90. Similarly, the proximal end 41 of adjustable length lever arm 40 may also comprise vertically projecting gear teeth 92. Vertically projecting gear teeth 90 on short arm 30 mate with vertically projecting gear teeth 92 on adjustable length internal lever arm 40. As seen in FIGS. 9C and 9D, a locking plug 200 can be provided for holding short arm 30 and lever arm 40 together. To adjust the angle between arms 30 and 40, locking plug 200 is unseated (FIG. 9D), and the arms are rotated to a preferred location. Next, locking plug 200 is re-seated (FIG. 9C), such that gears 90 and 92 mesh together and prevent rotation.

It is to be understood that the connection mechanisms described on the ends of each of arms 30 and 40 could be reversed, and that the present system can encompass any form of connection mechanisms including, but not limited to, ridges, teeth, gears, or snaps.

What is claimed is:

1. A toilet flush lever arm assembly comprising:

(a) an external flush lever arm;

(b) a short arm connected to the external flush lever arm; and (c) an adjustable length internal lever arm connected to the short arm, wherein the adjustable length internal lever arm comprises an inner shaft and a hollow outer slider, the outer slider including a plurality of apertures configured to receive a projection coupled to the inner shaft to hold the inner shaft at a desired position in the hollow outer slider.

2. The assembly of claim 1, wherein the short arm holds the adjustable length internal lever arm at an adjustable angle.

3. The assembly of claim 2, wherein the adjustable angle is rotatable.

4. The assembly of claim 2, wherein the short arm comprises a connection mechanism for attachment to the adjustable length internal lever arm, and wherein the connection mechanism allows for locking and unlocking of the adjustable length internal lever arm at different angles with respect to the short arm.

5. The assembly of claim 4, further comprising a connection mechanism on the adjustable length internal lever arm, wherein the connection mechanisms on the short arm and on the adjustable length internal lever arm interlock with one another.

6. The assembly of claim 4, wherein the connection mechanism on the short arm comprises outwardly deflectable teeth, and wherein, the connection mechanism on the adjustable length internal lever arm comprises teeth positioned within the outwardly deflectable teeth of the short arm.

7. The assembly of claim 4, wherein the connection mechanism on the short arm comprises inwardly facing teeth, and wherein the connection mechanism on the adjustable length internal lever arm comprises inwardly deflectable teeth within the inwardly facing teeth of the short arm.

8. The assembly of claim 4, wherein the connection mechanism on the short arm comprises vertically projecting gear teeth, and wherein the connection mechanism on the adjustable length internal lever arm also comprises vertically projecting gear teeth, and wherein the vertically projecting gear teeth on the short arm mate with the vertically projecting gear teeth on the adjustable length internal lever arm.

9. The assembly of claim 8, further comprising:

a locking plug for holding the short arm against the adjustable length internal lever arm.

10. The assembly of claim 1, wherein the short arm passes through a wall of a toilet tank.

11. The assembly of claim 1, wherein the external flush lever arm rotates around a longitudinal axis passing through the short arm.

12. The assembly of claim 1, wherein the distal end of the adjustable length internal lever arm comprises a plurality of apertures for connecting to a toilet flapper assembly.

13. The assembly of claim 1, wherein the shaft has a projection thereon and the slider has a plurality of apertures along its length and wherein the projection on the shaft protrudes through one of the apertures to fix the slider at a desired position along the length of the shaft.

14. The assembly of claim 13, wherein the shaft has a hollow mid-section adjacent to the projection thereon.

15. A toilet flush lever arm assembly comprising:

(a) an external flush lever arm;

(b) a short arm connected to the external flush lever arm; and (c) an adjustable length internal lever arm connected to the short arm, wherein the adjustable length internal lever arm comprises:

(i) a shaft, (ii) a slider received onto the shaft, and (iii) a locking mechanism to fix the slider at a desired position along the length of the shaft; and wherein the locking mechanism comprises deflectable snaps on the slider that rotate to lock into apertures in the shaft.

* * * * *